US005294867A

United States Patent [19]

Grossman

[11] Patent Number: 5,294,867

[45] Date of Patent: Mar. 15, 1994

[54] LOW PRESSURE MERCURY VAPOR DISCHARGE LAMP CONTAINING AN AMALGAM

[75] Inventor: Mark W. Grossman, Belmont, Mass.

[73] Assignee: GTE Products Corporation, Danvers, Mass.

[21] Appl. No.: 850,763

[22] Filed: Mar. 13, 1992

[51] Int. Cl.[5] ..... H01J 17/22

[52] U.S. Cl. ..... 313/490; 313/565; 313/552; 313/634; 313/609; 313/611

[58] Field of Search ..... 313/565, 564, 552, 561, 313/490, 634, 609, 611

[56] References Cited

U.S. PATENT DOCUMENTS

| | | | |
|---|---|---|---|
| 3,869,772 | 3/1975 | Latassa et al. | 29/25.13 |
| 3,898,720 | 8/1975 | Morehead | 29/25.13 |
| 4,093,889 | 6/1978 | Bloem et al. | 313/490 |
| 4,157,485 | 6/1979 | Wesselink et al. | 313/174 |
| 4,288,715 | 9/1981 | van Overveld et al. | 313/174 |
| 4,393,325 | 7/1983 | van der Kooi | 313/552 |
| 4,528,209 | 7/1985 | Anderson et al. | 427/67 |
| 4,853,591 | 8/1989 | Klein et al. | 313/634 |
| 4,977,349 | 12/1990 | Asakura et al. | 313/490 |

FOREIGN PATENT DOCUMENTS

| | | | |
|---|---|---|---|
| 59-148258A | 8/1984 | Japan | 313/490 |
| 1097090 | 11/1967 | United Kingdom . | |
| 2157883 | 10/1985 | United Kingdom . | |

OTHER PUBLICATIONS

Bloem et al, "Amalgams for fluorescent lamps", Philips Tech. Rev. 38, 1978/79, pp. 83-88.

*Primary Examiner*—Donald J. Yusko
*Assistant Examiner*—Matthew J. Esserman
*Attorney, Agent, or Firm*—Robert E. Walter

[57] ABSTRACT

A compact low pressure mercury vapor discharge lamp which utilizes an amalgam for reducing the vapor pressure of mercury by absorption. The lamp has a tubulation positioned at a location spaced from the lamp electrodes which is in communication with an arc sustaining gas and includes a container for retention of liquified amalgam within the tubulation. The mercury vapor from the electrical charge sustaining gas is in communication with the amalgam for absorption.

16 Claims, 1 Drawing Sheet

LOW PRESSURE MERCURY VAPOR DISCHARGE LAMP CONTAINING AN AMALGAM

FIELD OF THE INVENTION

This invention relates in general to a low pressure mercury vapor discharge lamp containing an amalgam and pertains, more particularly, to the retention of the amalgam in the lamp such that it regulates the mercury vapor pressure and permits the lamp to be operated efficiently and with high lumen output.

BACKGROUND OF THE INVENTION

The mercury vapor density or mercury vapor pressure in fluorescent lamps is an important parameter in determining lumen output and lamp efficacy. Low-pressure mercury vapor discharge lamps have a maximum efficiency of converting the electrical energy supplied into ultraviolet radiation at a predetermined vapor pressure. It is known that the envelope cold spot temperature for most efficient lamp operation is approximately 40° C. This temperature causes a mercury vapor pressure of approximately 4 to $6\times10^{-3}$ Torr to occur inside the lamp.

The mercury vapor pressure is typically very highly dependent on the temperature of operation of the lamp. Often, due to high lamp loading or high ambient temperature, the envelope temperature and mercury vapor pressure rise above the optimum value. As the temperature of lamp operation increases, the vapor pressure and density of mercury in the discharge lamp tend to increase above the desired levels required for optimum light output and efficiency of operation.

It is well known to control the mercury vapor pressure by use of an metal or metal alloy which forms an amalgam with mercury. As the mercury vapor pressure increases to an undesirable level, the amalgam begins to melt and form a solution with mercury vapor so as to decrease the vapor pressure of the mercury and return the lamp to a more optimal operation. Amalgams of indium and bismuth are known to possess these desirable properties.

It is also known that the location of the amalgam in the lamp is an important fact in providing the desired improvement. In practice, the lamp temperature can vary significantly relative to the desired stabilization of the lamp. Thus, the location of the alloy will effect its temperature and, in turn, the mercury vapor pressure. J. Bloem et al., "Amalgams for Fluorescent Lamps", Philips Tech. Rev., 38, 83–88 (1978) suggests that the location of amalgams can be important for lamp starting if the heat from the filament can be coupled to the amalgam. U.S. Pat. Nos. 3,869,772 to Latassa et al, 3,898,720 to Morehead, and 4,157,485 to Wesselink et al describe the glass stem as a desirable location for the amalgam which may be alloys of indium, bismuth, and tin. British Patent Specification No. 1,097,090 to Sylvania discloses positioning amalgam at certain locations in fluorescent lamps.

U.S. Pat. Nos. 4,977,349 to Asakura et al, and 4,288,715 to van Overveld et al, as well as U.K. application no. 2,157,883 describe compact type low-pressure mercury vapor discharge lamps having a folded path between the electrodes which employ an amalgam in the electrode stem area. In the '349 patent, a restriction in a receptacle aids in keeping the amalgam confined to the receptacle. However, during base up lamp processing amalgam has a tendency to fall into the lamp. When the ballast is included in the lamp base, the temperatures in the stem area may be undesirably high for the amalgam. U.S. Pat. No. 4,393,325 to van der Kooi describes a compact lamp with a build in ballast included in the lamp base and the amalgam positioned away from the stem area. The amalgam is in a separate metal container having a slit opening to the arc discharge area.

Although the above-described amalgam containing low-pressure mercury vapor discharge lamps have been employed with varying degrees of success, it has been found that certain disadvantages do exist. It is difficult to contain the amalgam during lamp processing and lamp operation when the lamp base is in an upward position. It is also difficult to incorporate the amalgam into the lamp at a location which is responsive to temperature at which the desirable absorption properties of the amalgam are advantageously utilized.

SUMMARY OF THE INVENTION

It is, therefore, an object of the present invention to obviate one or more of the disadvantages of the prior art.

In accordance with the present invention, there is provided a compact low pressure mercury vapor discharge lamp of the type including an amalgam for absorbing mercury vapor by contacting an exposed surface portion of the amalgam, the lamp comprises a sealed glass envelope having disposed therein ingredients comprising mercury for forming an electric arc sustaining gas within the interior of the glass envelope, a pair of electrodes mounted in sealing relationship with the glass envelope and adapted for generating an electrical arc discharge along a path through the arc sustaining gas, a tubulation positioned at a location spaced from the electrodes, said tubulation having one end in communication with the arc sustaining gas and the other end being closed, and a container confined within said tubulation and adapted for retention of liquified amalgam within the tubulation wherein mercury vapor from the electrical charge sustaining gas is in communication with the amalgam for contacting an exposed surface of the amalgam for absorption.

In accordance with an embodiment of the present invention, the amalgam is positioned at a particular location in a twin tube lamp conducive to lamp manufacture and operation. During lamp manufacture, lamps are typically processed with the base up utilizing cooling to maintain the alloy as a solid for retention purposes. For some manufacturing conditions, it is difficult to pool the alloy. In the present invention, the container retains the alloy even in its melted state during base up manufacturing.

In a compact low pressure mercury vapor discharge lamp of a twin tube configuration, a pair of U-shaped tubes each include a pair of substantially parallel inner and outer legs. The respective inner and outer legs are connected at one end of the lamp by a transversely extending bridging section. The inner and outer legs are closed at the opposite end of the lamp. A connecting conduit joins respective inner legs for completing the discharge path between the electrode assemblies. A pair of electrodes are positioned at the respective closed ends of the outer legs and at least one of the closed ends of the inner legs includes a tubulation.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompany drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
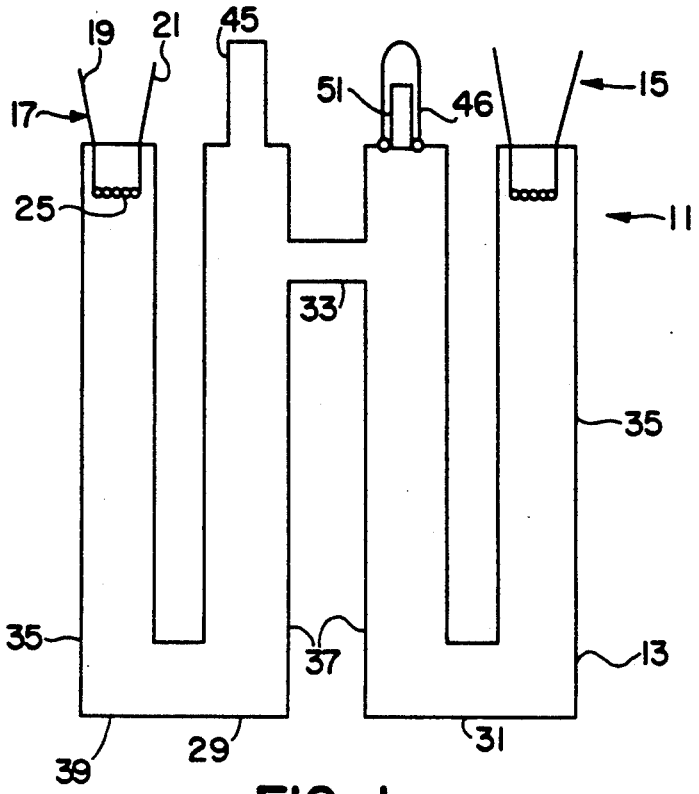
FIG. 1 is a schematic drawing of a double twin tube compact fluorescent lamp having a tubulation.

Referring to the drawings, FIG. 1 illustrates a fluorescent lamp 11 which includes a folded elongated light-transmissive sealed envelope 13 having a generally circular cross section. A discharge assembly includes a pair of electrode assemblies 15,17. Each of the assemblies 15,17 include a pair of lead-in-wires 19,21 which are sealed in a stem mount. Each of the lead-in-wires 19,21 are connected to the respective ends of an electrode 25. The envelope 13, as finally assembled, is subjected to a vacuum and contains a conventional discharge sustaining fill which includes mercury. The inner surface of the elongated glass envelope 13 is coated with a phosphor powder.

The compact fluorescent lamp 11 twin tube configuration as illustrated in FIG. 1 includes a pair of U-shaped tubes 29,31 joined by a connecting conduit 33 for completing the discharge path between the electrode assemblies 15,17. Each of the U-shaped tubes 29,31 includes a pair of legs 35,37 which are joined by a transverse bridging section 39. The legs 35,37 are in a substantially parallel alignment and in the same plane although other arrangements are contemplated. Respective inner legs 37 are joined to respective outer legs 35 at the bridging section 39 at one end of the lamp. At the opposite end of the lamp, the respective ends of the legs 35,37 are closed. The closed ends of the outer legs 35 include the electrodes while the closed ends of the inner legs are shown with tubulations 45 and 46.

In terms of the overall assembly of the fluorescent lamp 11, leg 35 is at an exterior portion of the lamp 11 and leg 37 is at an interior portion of the lamp 11. The respective interior legs as represented by 37 are connected by transversly extending conduit 33 at a position spaced from the closed ends. The end portions of the respective inner legs 37 include tubulations 45 and 46. As illustrated in FIG. 1, the tubulation 45 associated with tube 29 is preferably available for exhausting the interior of the lamp envelope and adding fill during lamp manufacture. The tubulation associated with the other inner tube 37 includes the container and amalgam as shown in detail in FIG. 2.

During the exhausting step, the envelope is typically heated to release water absorbed on the inside surfaces. During the lamp manufacturing process, the chemicals may be introduced prior to removal of the tubulation. The tubulation 45 communicates with the envelope 13 for exhausting air and other gas from the envelope and introducing desirable fill ingredients into the envelope 13. The tubulation 45 is shown in the drawing as being tipped off but it also may be removed. Not that the above steps may be performed after the amalgam 49 (FIG. 2) and container 51 have been positioned in tubulation 46.

FIG. 2 illustrates the manufacturing steps for incorporating the container 51 and amalgam 49 in the tubulation 46 in detail. Due to the technique of forming the tubulation 46, the tubulation 46 has a restriction 47 at the junction with the envelope 13 (FIG. 1). The details of manufacture as set forth in FIG. 2 described in more detail in the subsequent description.

The compact low pressure and normally low temperature mercury vapor discharge lamp 11 of the type includes an amalgam 49 which is sufficiently exposed for contacting the gaseous discharge ingredients. The term amalgam is used to refer to a material which is capable of absorbing mercury vapor from the lamp volume. Typically the amalgam is a metal alloy such as an alloy containing bismuth and indium. Such an alloy is generally ductile at temperatures of about 100° C. and may become liquid at higher lamp operating temperatures. The purpose of the amalgam 49 is to stabilize the mercury vapor pressure at relatively high operating temperatures at which the mercury vapor pressure undesirable increases.

The amalgam 49 is not directly in the discharge space but is accessible to the discharge space. The lamp comprises a sealed glass envelope having disposed therein ingredients comprising a rare gas and mercury for forming an electric discharge sustaining gas within the interior of the glass envelope. A pair of electrodes are mounted in sealing relationship with the glass envelope and adapted for generating an electrical discharge through the arc sustaining gas. As illustrated in FIG. 1, the discharge path extents from electrode assembly 15, down and around U-shaped tube 31, through the connecting conduit 33, down leg 37, through bridging section 39, and up leg 35 of U-shaped tube 29. The tubulation 46 containing the amalgam is spaced from the discharge path so that the temperature in the tubulation 46 remains relatively low during normal operation of the lamp 11 and the mercury absorbing properties of the amalgam 46 are not fully utilized.

The tubulation 46 is positioned at a normally lower temperature location spaced from the electrodes and electrode assemblies 15 and 17. The tubulation 46 is also positioned away from the direct path of the the discharge. The tubulation 46 has one end in communication with the arc sustaining gas through the restriction 47.

The purpose of the amalgam is to control the mercury vapor pressure in the lamp through its mercury absorbing properties. Intuitively, one can consider the analogy of an ideal solution to the mercury-alloy system. In the ideal case the vapor pressure of the component under consideration is reduced in proportion to the mole fraction of the component in solution, $$P = P^o X_A$$

Where

P = Hg vapor pressure over solution $P^o$ = pure Hg vapor pressure at given temperature $X_A$ = mole fraction in solution = $m_{Hg}/m_{Hg} + m_{Alloy}$)

$m_{Hg}$=moles of Hg in solution
$m_{Alloy}$=moles of solvent

Assume that the desired mercury vapor pressure is $6\times10^{-3}$ Torr, corresponding to a control point temperature of 40° C. It is not uncommon for compact fluorescent lamps running in recessed fixtures to reach control point temperatures of 80° C. This corresponds to a mercury vapor pressure of $88\times10^{-3}$ Torr. Based on the above ideal solution equation the required mole fraction of Hg to reduce the mercury vapor pressure from 88 mTorr to 6 mTorr would be $$X_A=6.0/88=0.068$$

As a specific example consider the In-Hg amalgam. Assume an ideal solution. The corresponding mole ratio of indium to Hg would be $$m_{Alloy}/m_{Hg}=14$$

A typical mercury dose of 10 mg or $5\times10^{-5}$ moles implies an indium mass of 78 mg. This is in the range of ratios of Hg to indium used in practice. When temperatures are high enough so that the amalgam begins to melt the mercury vapor pressure variation with increasing temperature can reach a stabilized region. As discussed in reference J. Bloem et al., "Some New Mercury Alloys for Use in Fluorescent Lamps", J. of IES, 141, April, (1977), this occurs such that the maximum vapor pressure in the stable region is given as (ideal solution approximation)

$$P_m=P^o2.2T_m/14{,}660$$

where
$P_m$=maximum mercury vapor pressure in stabilized region
$T_m$=melting point temperature of alloy Since Hg and alloys form solutions with are not ideal, departures from the above ideal solution case are expected. A more general treatment of the vapor pressure above a solution can be obtained by considering the vapor pressure to be given as $$P=gP^oX_A$$

where
g=activity coefficient (1 for an ideal solution)

This is discussed in more detail in the reference set forth above. As an estimate the ideal solution expression for $P_m$ required for 80° C. control spot can be readily obtained. Since $$P_m/P^o=0.068$$

$$T_m=14660*0.068/(2.2)=453K=182°\ C.$$

In terms of real solutions the system $$Bi_{0.468}I_{0.532}$$

reduces the mercury vapor pressure so that even though its melting point is 110° C. the desired vapor pressure (at 6% to 12% weight Hg) shows the importance of knowing the value of the activity coefficient for predictability of new amalgam systems.

Preferred amalgams include a metal alloy containing bismuth and indium and a metal alloy containing bismuth, tin, and lead.

FIG. 2 illustrates the method of manufacture of the lamp 11 of the present invention incorporating amalgam 49 in a manner so as to retain the amalgam 49 in the tubulation 46 even when the amalgam 49 is liquified. In accordance with the principles of the present invention, the amalgam 49 is retained in a container 51. As illustrated in FIG. 2A, a solid body of the amalgam 49 is placed in the cup-shaped container 51. In one embodiment, the container 51 was of a Nicromet 426 material having a height of 0.200 inch, a diameter of 0.085 inch, and a wall thickness of 0.003 inch. The container 51 as illustrated in the drawing is closed at the bottom and open at the top. It is contemplated that the container 51 may include wall perforations which increase the surface area of the amalgam 49 available for contacting the discharge gas. During processing of the lamp the openings can prevent outgassing. In this later case, it is contemplated that such perforations or openings are sufficiently small so that liquified amalgam 49 will be retained in the container 51 by surface tension.

Figure 2A:
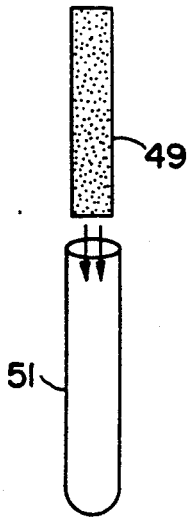
FIGS. 2*a*–2*d* illustrate a container holding amalgam in the tubulation.
Figure 2B:
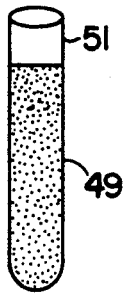
Figure 2C:
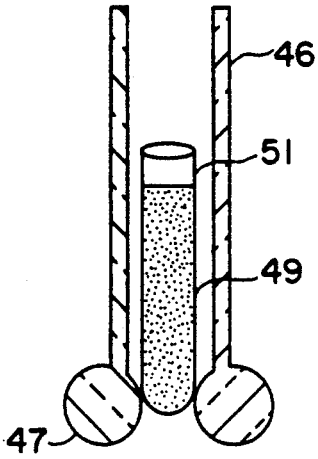

Next the container and amalgam are heated to melt the amalgam 49 so that it conforms to the shape of the container. FIG. 2B illustrates a container 51 holding the amalgam 49 which has an exterior shape conforming to the interior shape of the container 51. As illustrated in FIG. 2C, the container 51 is inserted into the open end of the tubulation 46. The restriction 47 is less than the diameter of the container 51 so that the container is retained in the tubulation 46 and cannot pass into the main discharge area of the lamp 11. The diameter of the tubulation 46 is larger than the container 51 so that the container 51 is loosely or moveable held in the tubulation so that discharge gases are free to communicate with the amalgam 49 around the container 51. In the embodiment utilizing the above mentioned container 51, the tubulation 46 had an inside diameter of about 0.10 inch.

Figure 2D:
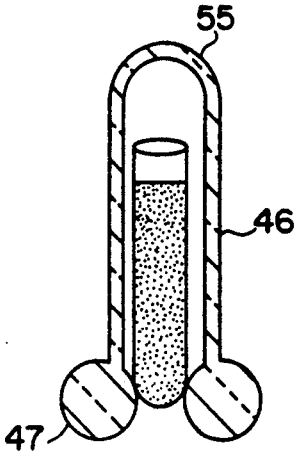

As illustrated in FIG. 2D, the exposed or open end 55 of the tubulation 46 is sealed or tipped off by melting the glass. The resulting tubulation 46 has one closed end, a restriction 47 at the other end, and container 51 holding the amalgam 49 confined within the tubulation 46. Thus, when the lamp 11 is mounted with base or the electrode assembles 15,17 up, the container 51 retains amalgam 49 even if it is a liquid. This position is illustrated in detail in FIG. 2D. It is contemplated that the restriction 47 is sufficiently narrow so as to stop the movement of the container 51. The contacting between the container 51 and the restriction 47 should enable discharge gas to flow through the restriction 47 so as to contact an exposed surface of the amalgam 49 during lamp 11 operation. In the embodiment of the invention as described above, the height of the closed tubulation 46 as measured from the restriction was about 0.350 inch. Thus, a small space was provided above the container 51 for the container 51 to float or move.

While there have been shown and described what are at present considered to be the preferred embodiments of the invention, it will be apparent to those skilled in the art that various changes and modifications can be made herein without departing from the scope of the invention. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. In a low pressure mercury vapor discharge lamp of the type having an amalgam for absorbing mercury vapor by contacting an exposed surface portion of the amalgam, a sealed glass envelope having disposed therein ingredients comprising mercury for forming an electric arc sustaining gas within the interior of the glass envelope, a pair of electrodes mounted in sealing relationship with said glass envelope, a tubulation positioned at a location spaced from said electrodes, said tubulation having one end in communication with said arc sustaining gas and the other end being closed, and a container confined within said tubulation and adapted for retention of liquified amalgam within said tubulation wherein mercury vapor from said electric arc sustaining gas is in communication with said amalgam for absorption, wherein the improvement comprises a restriction at the other end of said tubulation wherein said container holds the amalgam confined within the tubulation when said lamp is mounted with said electrodes in an upward position.

2. A low pressure mercury vapor discharge lamp according to claim 1 wherein said lamp is a compact fluorescent lamp.

3. A low pressure mercury vapor discharge lamp according to claim 2 wherein said fluorescent lamp comprises a twin tube configuration including a pair of U-shaped tubes, each U-shaped tube includes a pair of substantially parallel inner and outer legs, said respective inner and outer legs being connected at one end of the lamp by a transversely extending bridging section, said inner and outer legs being closed at the opposite end of the lamp, connecting conduit joining said respective inner legs for completing the discharge path between said pair of electrodes positioned at the respective closed ends of said outer legs, at least one of the closed ends of said inner legs including said tubulation.

4. A low pressure mercury vapor discharge lamp according to claim 3 wherein said tubulation includes a restriction at a junction with the envelope.

5. A low pressure mercury vapor discharge lamp according to claim 4 wherein said tubulation projects outwardly from said junction with the envelope along the direction of inner leg.

6. A low pressure mercury vapor discharge lamp according to claim 5 wherein said amalgam is sufficiently exposed for contacting said ingredients.

7. A low pressure mercury vapor discharge lamp according to claim 6 wherein said amalgam is a metal alloy containing bismuth and indium.

8. A low pressure mercury vapor discharge lamp according to claim 6 wherein said amalgam is a metal alloy containing bismuth, tin, and lead.

9. A low pressure mercury vapor discharge lamp according to claim 5 wherein said amalgam is accessible to the discharge space through said tubulation.

10. A low pressure mercury vapor discharge lamp according to claim 5 wherein said container is closed at the bottom and open at the top.

11. A low pressure mercury vapor discharge lamp according to claim 10 wherein said container includes wall perforations for outgassing said amalgam.

12. A low pressure mercury vapor discharge lamp according to claim 11 wherein said perforations are sufficiently small so that liquified amalgam is retained in the container by surface tension.

13. A low pressure mercury vapor discharge lamp according to claim 10 wherein said amalgam conforms to the shape of the container.

14. A low pressure mercury vapor discharge lamp according to claim 10 wherein said restriction is less than the diameter of the container.

15. A low pressure mercury vapor discharge lamp according to claim 10 wherein said container is movably held in the tubulation so that discharge gases are free to communicate with the amalgam around said container.

16. A low pressure mercury vapor discharge lamp according to claim 10 wherein said discharge gas may flow through the restriction so as to contact an exposed surface of the amalgam during lamp operation.

* * * * *